US006579137B2

(12) United States Patent
Mabru

(10) Patent No.: US 6,579,137 B2
(45) Date of Patent: Jun. 17, 2003

(54) MARINE OUTBOARD ELECTRICAL GENERATOR AND ASSEMBLY METHOD

(75) Inventor: Alain A. Mabru, Parkland, FL (US)

(73) Assignee: Westerbeke Corporation, Taunton, MA (US)

( * ) Notice: Subject to any disclaimer, the term of this patent is extended or adjusted under 35 U.S.C. 154(b) by 0 days.

(21) Appl. No.: 10/198,830

(22) Filed: Jul. 18, 2002

(65) Prior Publication Data

US 2002/0177374 A1 Nov. 28, 2002

Related U.S. Application Data

(63) Continuation of application No. 10/045,914, filed on Oct. 29, 2001, which is a continuation of application No. 09/570,216, filed on May 12, 2000, now Pat. No. 6,309,268.

(60) Provisional application No. 60/165,478, filed on Nov. 15, 1999.

(51) Int. Cl.[7] ..... B63H 19/00

(52) U.S. Cl. ..... 440/113; 123/599; 290/1 R

(58) Field of Search ..... 440/1, 113, 88, 440/89, 900; 123/599; 290/1 R

(56) References Cited

U.S. PATENT DOCUMENTS 2,879,738 A 3/1959 Culbertson
4,010,377 A 3/1977 McKenzie
4,695,261 A 9/1987 Broughton et al.
5,011,442 A 4/1991 Polcz et al.
5,530,305 A * 6/1996 Krueger et al. ..... 310/263

* cited by examiner

*Primary Examiner*—Jesus D. Sotelo
(74) *Attorney, Agent, or Firm*—Fish & Richardson P.C.

(57) ABSTRACT

A outboard marine electrical generator unit capable of installation on the transom of a marine vessel which provides an electrical generating unit for small and medium sized marine vessels. The invention thus provides an A/C and D/C electrical power source capable of providing electrical power for appliances, air conditioning units and other electrical loads, even while the primary propulsion system is off and the vessel is docked or at anchor. The electrical generator includes: (1) a housing, including upper and lower portions, generally having the external appearance of an outboard motor; (2) an internal combustion engine; (3) a permanent magnet electrical alternator, including a rotor and stator, and a cooling fan, mechanically connected to the engine crankshaft; (4) a carburetor assembly, including feedback control responsive to electrical load; (5) an inverter module, including pulse-width-modulation ("PWM") voltage regulation system and D/C-A/C inverter frequency regulation system; (6) an exhaust system terminating at the lower housing portion in a typically submerged location; (7) a fuel storage and delivery system, including either an internal and/or external fuel tank and a fuel pump; and (8) a transom mounting mechanism, preferably including a tilt feature.

22 Claims, 6 Drawing Sheets

MARINE OUTBOARD ELECTRICAL GENERATOR AND ASSEMBLY METHOD

CROSS-REFERENCE TO RELATED APPLICATIONS

This application is a continuation of U.S. Ser. No. 10/045,914, filed Oct. 29, 2001 now U.S. Pat. No. 6,435,925, which is a continuation of U.S. Ser. No. 09/570,216, filed May 12, 2000 and now U.S. Pat. No. 6,309,268, and claims the benefit of Provisional U.S. Patent Application Serial No. 60/165,478, filed Nov. 15, 1999.

STATEMENT REGARDING FEDERALLY SPONSORED RESEARCH AND DEVELOPMENT

N/A.

BACKGROUND OF THE INVENTION

1. Field of the Invention

The present invention relates to marine electrical generators, and more particularly to an electrical generator adapted for installation on the transom of a marine vessel. Electrical power is generated by an internal combustion engine, including a submerged exhaust port for discharging combustion gases below water, and a permanent magnet alternator. The electrical generator provides a reliable and cost effective source of A/C and D/C electrical power for use aboard marine vessels.

2. Description of the Related Art

Marine vessels require power for many purposes. For example, a substantial amount of power is typically required for propulsion (i.e. power to drive the propeller). In addition, power is also required for onboard electrical service (i.e. lighting, communication and navigation electronics, etc.). As the power demands for propulsion and onboard electrical service vary widely, large vessels are often equipped with two separate power generation systems—one for propulsion and one for electrical power. Small and medium size vessels, however, are often forced to rely on the limited supply of electrical power available from the engine that drives the primary propulsion system, such as the electrical power produced by an outboard motor. In situations where the primary means of propulsion is an outboard motor, the availability of electrical power is severely limited. As a result, small and medium size vessels are often forced to rely on an auxiliary portable generator unit as a source of electrical power. The use of portable generator units, however, presents a number of significant disadvantages including high cost, the presence of hot exhaust gases, excessive noise, difficult installations due to a lack of space, and the inability of transom mounting. Thus, the background art reveals a number of auxiliary power generation devices provided for use with outboard motors.

For example, U.S. Pat. No. 2,879,738, issued Mar. 31, 1959 (Culbertson), discloses a combined outboard motor and generating plant. The Culbertson reference discloses a generator mechanism comprising a rotating armature type device used to simultaneously propel a boat while generating electricity. U.S. Pat. No. 4,010,377, issued Mar. 1, 1977 (McKenzie), discloses a combined generator and boat propulsion system wherein the generator drive shaft is coupled to the propulsion unit drive shaft via a centrifugal clutch (16). McKenzie discloses an open framework device further provides a second/auxiliary drive sprocket (70). U.S. Pat. No. 4,695,261, issued Sep. 22, 1987 (Broughton), discloses a marine propulsion device having a voltage generator mounted thereto. Broughton discloses a configuration wherein the voltage generator is located in the recess in the underside of the flywheel and an annular power takeoff pulley (132) mounted on the flywheel. Broughton relies on a pulse generator (61) for the conventional capacitor discharge ignition circuit in addition to the power generator (63). U.S. Pat. No. 5,011,442, issued Apr. 30, 1991 (Polcz et al.), discloses an auxiliary power generation device for use in an outboard motor. Polcz et al. teach adapting an outboard motor by mounting an alternator coaxially with the flywheel to provide 1000 watts of D/C. power. The Polcz reference further discloses an available inverter for providing A/C power in addition to the D/C power supply.

The electrical generating devices of the background art, however, fail to provide a fully functional light weight outboard generator capable of being mounted on the transom and able to produce high quality and clean A/C and/or D/C electric power responsive to varying electrical loads while maintaining a substantially sound proof construction and a submerged exhaust.

BRIEF SUMMARY OF THE INVENTION

The present invention provides an outboard marine electrical generator unit capable of installation on the transom of a marine vessel. The outboard generator according to the present invention provides an electrical generating unit for small and medium sized marine vessels (specifically power and sail boats in the 20–40 foot range) that are otherwise not equipped with an auxiliary electrical generator and/or do not have space available for the installation of a conventional onboard marine generator. The invention thus provides an A/C and D/C electrical power source capable of providing electrical power for appliances, air conditioning units and other electrical loads, even while the primary propulsion system is off and the vessel is docked or at anchor.

An outboard marine electrical generator according to the present invention includes the following primary components: (1) a outboard motor-type housing, including upper and lower portions, generally having the external appearance of an outboard motor but for the absence of a propeller; (2) an internal combustion engine; (3) a permanent magnet electrical generating assembly, including a rotor, a stator, and a cooling fan, mechanically connected to the engine crankshaft; (4) a carburetor assembly, including feedback control responsive to electrical load; (5) an inverter module, including pulse-width-modulation ("PWM") voltage regulation system and D/C-A/C inverter frequency regulation system; (6) an exhaust system terminating at the lower housing portion in a typically submerged location; (7) a fuel storage and delivery system, including either an internal and/or external fuel tank and a fuel pump; and (8) a transom mounting mechanism, preferably including a tilt feature.

The above-referenced device provides a transom mountable marine outboard generator powered by a 4-stroke, single-cylinder gasoline engine that is capable of producing 1,000 VA at the following electrical ratings: 120 VAC/7.5 A/60 Hz and/or 12 VDC/8.0 A. The power supplied is sufficient to power, among other things, a 5,000 Btu marine air conditioning system for providing comfort cooling. The outboard generator weighs approximately 34 lbs, and is capable of operating for approximately 6 hours on a single gallon of gasoline. The outboard generator provides for the submerged discharge of exhaust thereby minimizing noise levels and reducing the likelihood that noxious exhaust fumes will accumulate in occupied parts of the vessel.

Outboard generators according to the present invention may be fabricated with greater electrical generating capacities using larger horsepower engines.

It is an object of the present invention to provide a transom mounted electrical generator for marine vessels.

Still another object of the present invention is to provide a transom mounted marine electrical generator capable of producing both A/C and D/C electrical power for providing small and medium sized marine vessels with sufficient and cost effective power for running a variety of electrically operated devices including cabin air conditioning units, lights, computers and other electronic devices.

DETAILED DESCRIPTION OF THE INVENTION

FIGS. 1 through 6 depict a preferred embodiment of a marine outboard generator according to the present invention. The present invention comprises an outboard marine A/C and D/C electrical generator for transom mounting on a marine vessel. The outboard generator provides an electrical generating unit for small to medium sized boats (specifically power and sail boats in the 20–40 foot range) that are otherwise not equipped with sufficient electrical generating capacity, or which are not configured and/or do not have sufficient space available for the installation of a conventional onboard marine generator. The invention thus provides an A/C and D/C electrical power source for powering appliances, air conditioning units and other electrical loads while the vessel cruises and/or is at anchor.

In a preferred embodiment, an outboard marine electrical generator according to the present invention includes the following primary components: (1) a housing, including upper and lower portions, preferably resembling a propellerless outboard motor; (2) an internal combustion gasoline engine; (3) an electrical generating assembly, including a stator, and a rotor and a cooling fan connected to the engine crankshaft; (4) a carburetor assembly, including a feedback controlled throttle control motor responsive to electrical load; (5) an inverter module, including pulse-width-modulation ("PWM") voltage regulation system and D/C-A/C inverter frequency regulation system; (6) an exhaust system terminating at a submerged outlet; (7) a fuel delivery system, including an external fuel tank and a fuel pump; and (8) a tiltable transom mounting mechanism.

By way of a preferred example there is disclosed a marine outboard generator based in part on a 2.0 HP air-cooled marine outboard engine. An outboard generator based on such an outboard engine results in a fully functional transom mounted electrical generator suitable for use on marine vessels for providing power for onboard electrical components and cabin air conditioning units. An outboard generator according to the present invention is compact, lightweight, extremely quiet and economical and provides a source of both A/C and D/C electrical power. In alternate embodiments, larger engines, e.g. 5–25 h.p. or larger, either air cooled or water cooled may be used to achieve higher electrical generating capacities.

Figure 1:
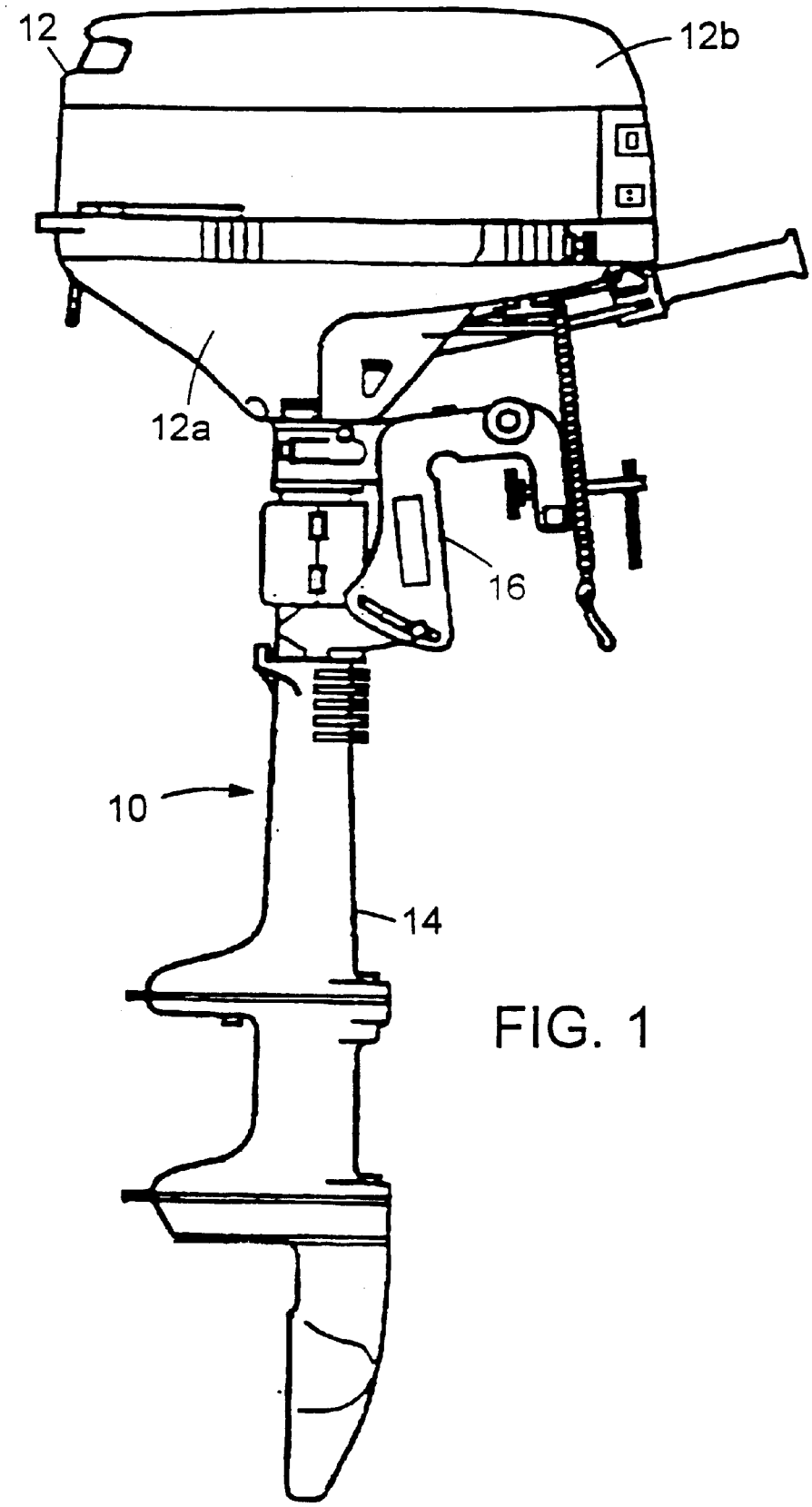
FIG. 1 is a side elevational view of a marine outboard generator according to the present invention.
Figure 2:
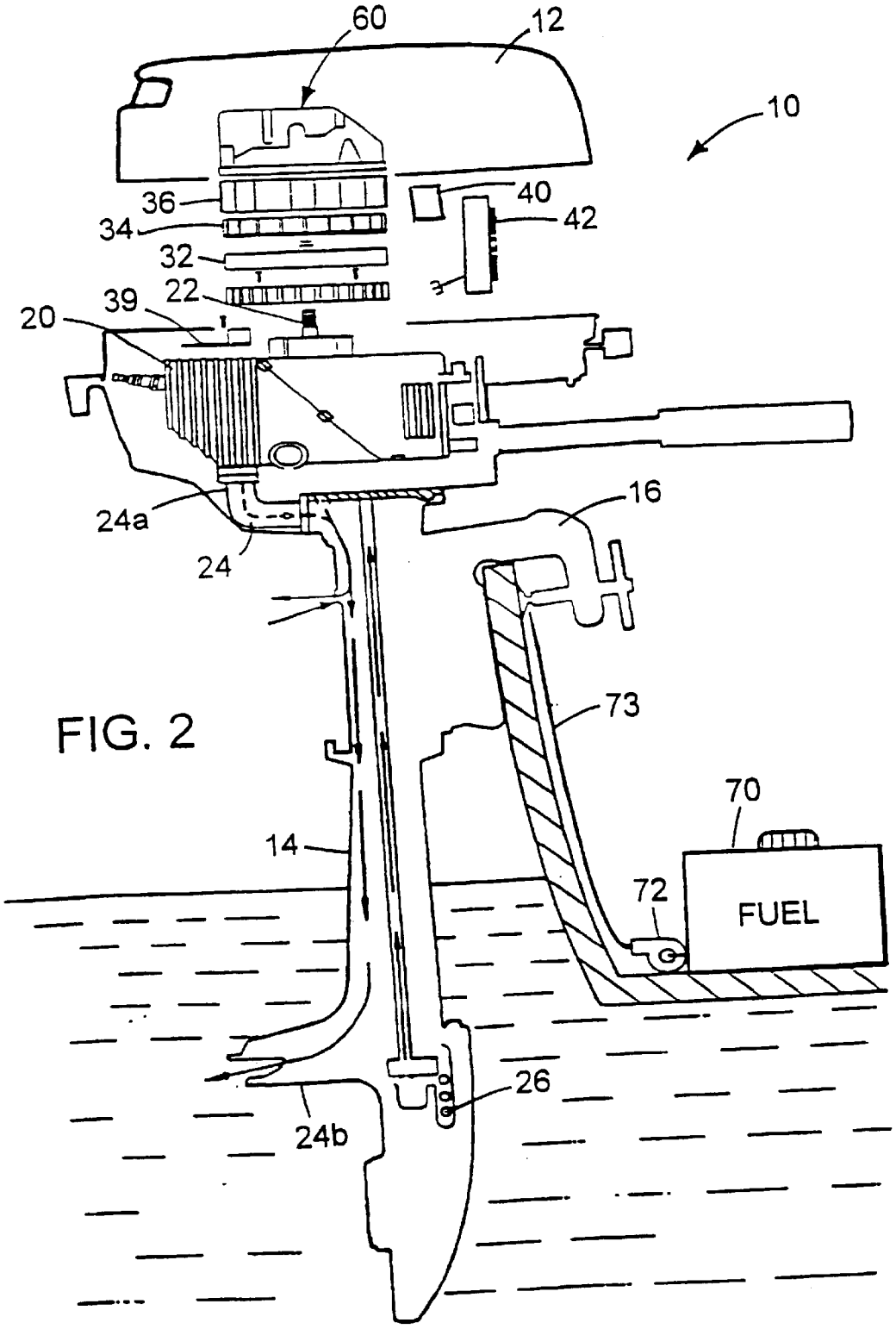
FIG. 2 is a partially exploded side elevational view of a water-cooled marine outboard generator according to the present invention, illustrating cooling water intake and submerged exhaust flow.

As best depicted in FIG. 1, a marine outboard generator according to the present invention, generally referenced as 10, includes a housing having an upper portion 12 and a lower portion 14. The housing is preferably generally shaped in the form of an outboard engine. It should be noted however, that the external shape of the outboard generator need not identically resemble an outboard engine, provided, however, that the generator include a housing having an upper portion for containing the internal combustion engine and generator components, and a lower portion for providing a submerged exhaust capability. Housing upper portion 12 includes an upper portion base 12A and a removable cover 12B. In addition, the generator includes a transom mounting mechanism 16 for attaching the generator to the transom of a marine vessel as shown in FIG. 2. Transom mounting mechanism 16 preferably comprises a quick connect clamp for secure attachment to the transom and may further include a tilt of pivot capability to allow the generator to be tilted when not in use such that the lower portion 14 rises above the water line.

As depicted in FIG. 2, housing upper portion 12 provides a protective enclosure for an internal combustion engine 20 mounted therein. In a preferred embodiment, capable of producing a maximum output of approximately 1,000 VA, the internal combustion engine may comprise a 4-stroke single cylinder engine having a displacement of approximately 3.5 cubic inches (57 $cm^3$). Such an engine is preferably air-cooled, but may be liquid-cooled (e.g. water-cooled, oil cooled etc.). Engine 20 has a suitable compression ratio, such as 8.0:1. The engine is preferably disposed in a horizontal configuration wherein the engine cylinder is generally horizontally disposed, however, a vertically disposed engine configuration remains within the scope of the present invention. The engine includes a piston that drives a crankshaft 22. Crankshaft 22 is generally vertically disposed within the housing. Engine 20 further includes an exhaust system, generally referenced as 24, having a first end 24A connected to the engine cylinder block and a second end 24B terminating in the housing lower portion for discharging exhaust at a submerged location.

Figure 3:
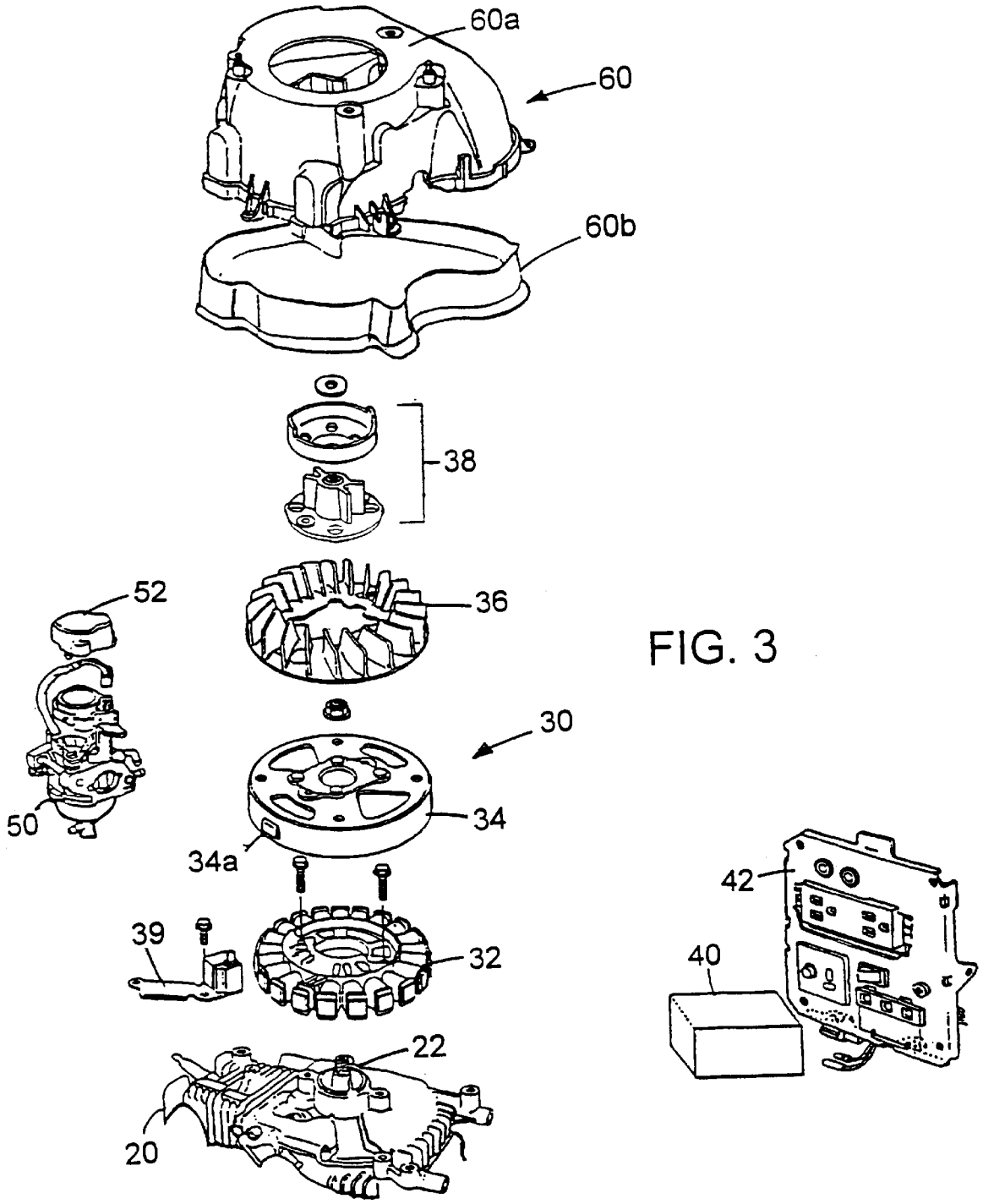
FIG. 3 is a partial exploded perspective view showing the rotor, stator, and cooling fan components in relation to the engine/crank shaft as found within the engine cowling.
Figure 5:
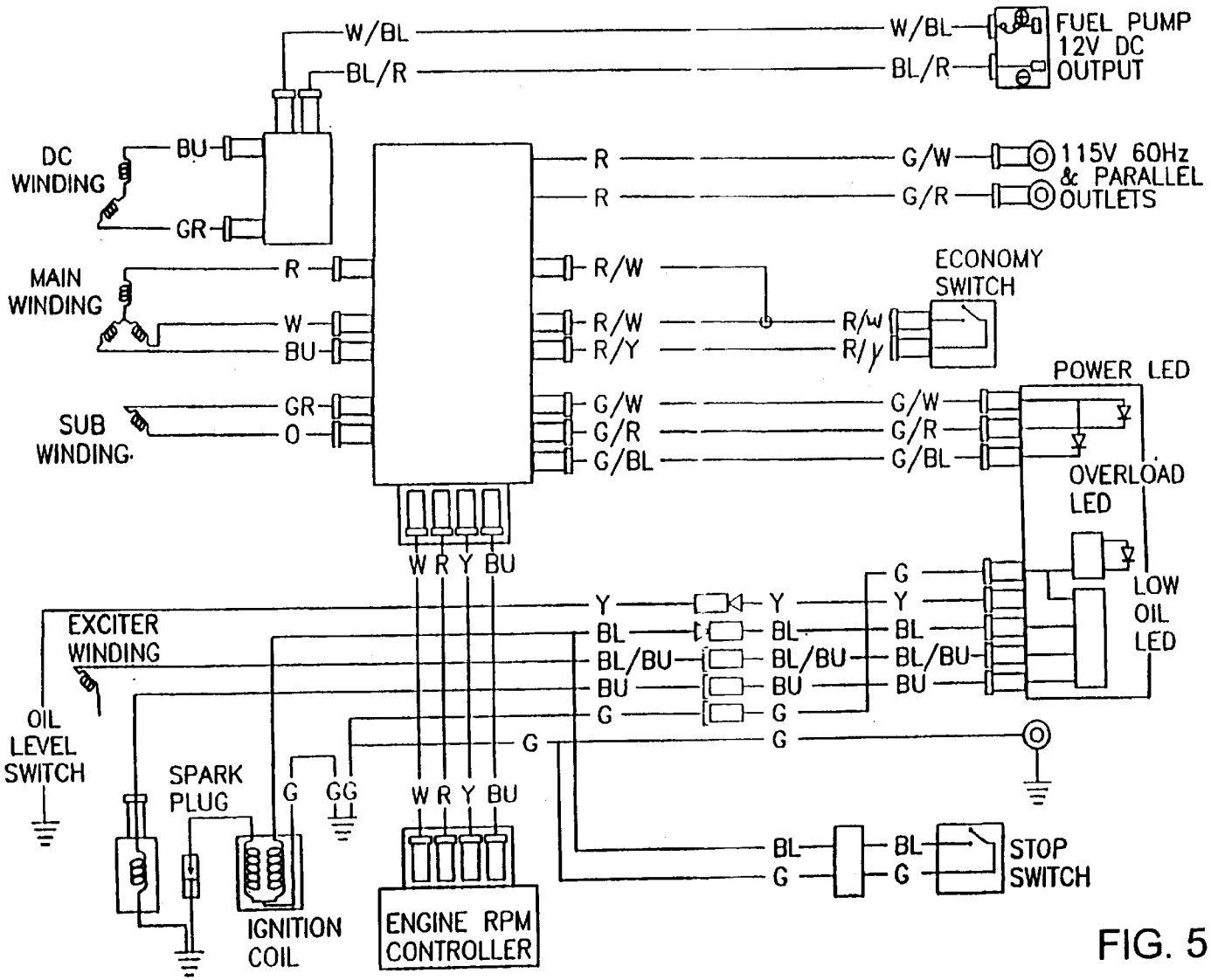
FIG. 5 is an electrical wiring schematic for a marine outboard generator according to the present invention.

An electrical generator assembly, generally referenced as 30, is connected to the top portion of the internal combustion engine. A significant aspect of the present invention includes the use of a permanent magnet alternator. The electrical generator assembly includes: a stator 32, fixed relative to engine 20; a rotor 34, having a permanent magnet 34A attached to a peripheral edge thereof, is fixedly connected to the engine crank shaft for rotation therewith; and a cooling fan 36, also connected to the engine crank shaft to provide forced air induction cooling. The use of a permanent magnet alternator provides a number of advantages in performance and safety. For example, the use of a permanent magnet alternator eliminates the need for a heavy counter balancing flywheel. Instead, the permanent magnet alternator relies on magnetic forces that are harnessed and synchronized with the engine cycle to counter balance periodic vibrational forces generated by movement of the piston. The elimination of the flywheel substantially reduces the cost and weight of an outboard generator fabricated according to the present invention as compared to a similar construction using brush-type alternators and/or any other flywheel type configuration. FIG. 5 shows an electrical wiring schematic for an outboard generator according to the present invention. As best seen in FIG. 3 an ignition pulse generator, referenced as 39, is mounted adjacent to the rotor/stator assembly and electrically connected to the engine's spark plug. The ignition pulse generator 39 is mounted in close proximity to the peripheral edge of rotor 34 which includes a signal generating permanent magnet, referenced as 34A. Ignition pulse generator 39 functions to send a properly timed spark generating electrical pulse to the spark plug thereby causing a spark within the engine's cylinder.

As best seen in FIG. 3, a recoil starter assembly 38, is connected to the engine crank shaft. The starter assembly includes a starter pulley 38 and a starter rope (not shown), which cooperate to function as a recoil starter. The outboard generator further includes a fuel tank having a fuel supply line fluidly connected to a twelve-volt DC (12 VDC) fuel pump located within the housing. In a preferred embodiment, a fuel tank 70 and 12 VDC pump 72 comprise a fuel storage and delivery system for the internal combustion engine. The fuel tank and pump may be mounted externally from the generator and onboard the marine vessel and function to deliver fuel to the internal combustion engine during operational periods. In an alternate embodiment (not shown) the fuel tank and pump may be incorporated into the housing for the internal combustion engine and/or fixedly attached externally to the housing.

Figure 4:
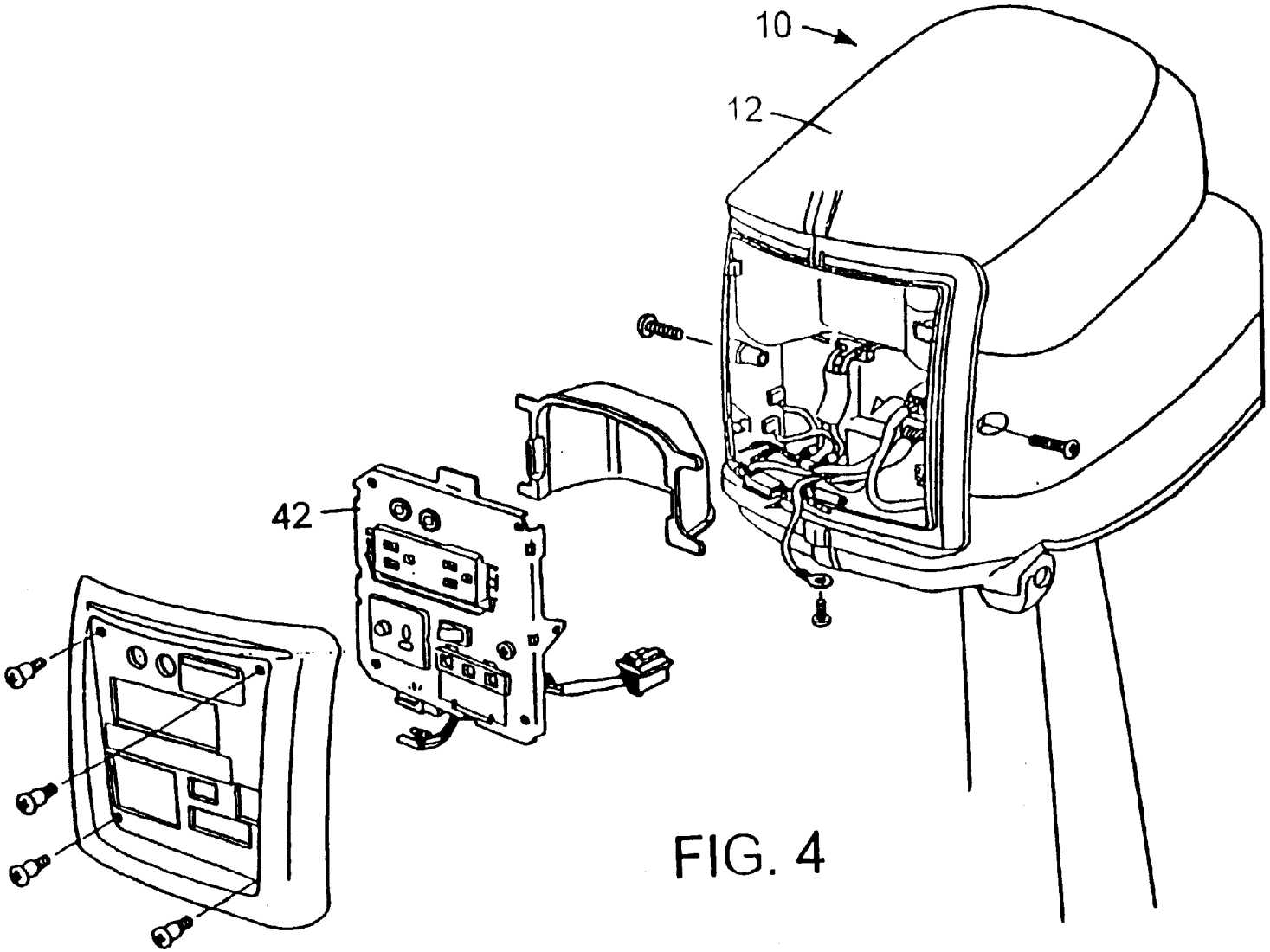
FIG. 4 is an exploded partial front perspective view detailing the front control panel assembly for the marine outboard generator.

The outboard generator further includes an inverter unit 40 and control panel 42. The inverter unit includes a pulse width modulation voltage regulation system and frequency regulation is accomplished by DC-AC conversion. The inverter unit is electrically connected to at least one AC output receptacle and at least one DC output receptacle, which receptacles may be incorporated on control panel 42 along with other control devices and gauges. As best seen in FIG. 4, the control panel is preferably incorporated into the housing upper portion 12 so as to face the stem of the marine vessel when the generator is mounted to the transom as shown in FIG. 2.

Figure 6:
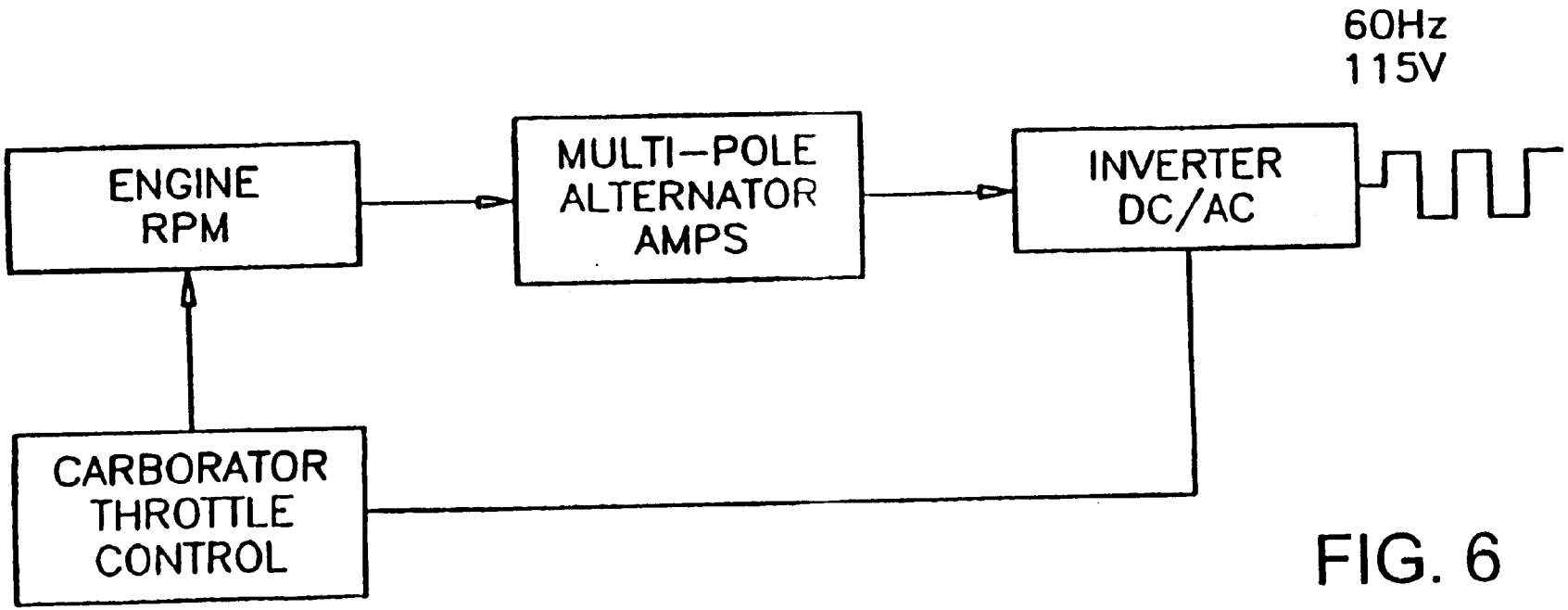
FIG. 6 is an electrical schematic showing the throttle control feed back circuit.

Engine 20 further includes a carburetor 50 and throttle control motor 52. Throttle control motor 52 is electrically connected to electrical load sensing circuitry and is responsive to the electrical load placed on the generator via a feedback control circuit as schematically illustrated in FIG. 6. Accordingly, the throttle continuously matches engine speed to the electrical load on the generator. For example, as the feedback control circuit senses that the electrical load placed on the generator is increasing a signal is sent to the throttle control motor to increase the throttle/fuel flow. Conversely, as the feedback control circuit senses that the electrical load placed on the generator is decreasing a signal is sent to the throttle control motor to decrease the throttle/fuel flow. FIG. 6 provides an electrical schematic of the throttle control load sensing feed back circuitry.

As best seen in FIG. 3, a cover assembly, generally referenced as 60, is disposed within the upper housing 12 and encloses all of the primary engine and generator components. The cover assembly, may include first and second components referenced as 60A and 60B respectively, and functions to protect the enclosed engine and generator components from salt water exposure while facilitating ventilation. In an air cooled embodiment, heat generated by the internal combustion engine and generator assembly is removed through convection cooling and is primarily achieved through forced air ventilation as fan 36, driven by engine 20, functions to draw air from the surrounding environment through housing 12 and cover 60 and around the engine prior to being discharged through housing ventilation ports.

The electrical generator is configured for use with a marine vessel by: (1) mounting the generator to the transom using transom mounting mechanism 16 as shown in FIG. 2; (2) installing the fuel tank, pump and fuel line; (3) electrically connecting AC and/or DC power consuming devices to the generator; and (4) starting the generator using the recoil starter mechanism. It should be noted that the electrical generator may be electrically connected directly to the vessel's power supply system, such as by electrically connecting an electrical output line from the generator to an electrical input on the vessel, such as the shore power input. In the alternative, individual power consuming devices, such as a marine cabin air conditioning unit, may be directly connected to the generator.

The internal combustion engine causes rotation of rotor 34 relative to stator 32 thereby generating a DC voltage potential that may be converted to an AC voltage potential by inverter 40. In an alternate embodiment, however, the alternator may directly produce AC electrical current which may then be routed through a PWM inverter assembly, which PWM inverter assembly may be remotely located from the transom mounted unit (e.g. onboard the marine vessel), to produce current at a desired voltage and frequency (e.g. 120 VAC/60 Hz). As illustrated in FIG. 6, engine RPM is controlled by a feedback control system to match electrical load. Exhaust from the internal combustion engine is discharged below the waterline through exhaust outlet 24B. Discharging the exhaust external to the vessel and below the waterline provides a safe and quiet means of handling the exhaust. As earlier disclosed the internal combustion engine may be either air-cooled or water-cooled. In the water cooled embodiment depicted in FIG. 2, water is drawn into the lower portion of the housing through a water intake 26 and routed through suitable engine cooling conduit whereafter the cooling water may be mixed with exhaust from the engine and discharged.

Attached hereto as a two page Appendix (A-1, and A-2) are specifications, dimensions and operating characteristics for a preferred embodiment of a marine outboard electrical generator according to the present invention. It should be noted, however, that other specifications, dimensions and operating characteristics are contemplated and within the scope of the present invention.

The present invention has been shown and described herein in what is considered to be the most practical and preferred embodiments. It is recognized, however, that departures may be made therefrom within the scope of the invention and that obvious structural and/or functional modifications will occur to a person skilled in the art.

What is claimed is:

1. A marine electrical generator comprising:

an internal combustion engine having a projecting crankshaft and an exhaust outlet for discharging engine exhaust; said internal combustion engine constructed to be securely mounted to a marine vessel; and a permanent magnet alternator mechanically connected to said crankshaft for producing electrical current, said permanent magnet alternator including a stator mechanically connected to said internal combustion engine, and a permanent magnet rotor connected to said crankshaft for rotation with respect to said stator for generating electrical current.

2. The electrical generator of claim 1 wherein the alternator is configured to generate synchronized magnetic forces to counterbalance periodic vibrational forces generated by piston movement within the engine.

3. The electrical generator of claim 1 wherein the crankshaft is disposed generally vertically, and wherein the alternator is disposed at an upper end of the crankshaft.

4. The electrical generator of claim 1 wherein the rotor comprises a permanent magnet attached to a peripheral edge thereof.

5. The electrical generator of claim 1 wherein the engine is rated at between 5 and 25 horsepower.

6. The electrical generator of claim 1 wherein the engine is an air cooled engine.

7. The electrical generator of claim 1 further comprising means for mounting said internal combustion engine to a transom of the marine vessel.

8. The electrical generator of claim 7 wherein said means for mounting said engine to the transom of a marine vessel includes a pivotal connection whereby said engine may be pivotally moved from a first position wherein said housing exhaust outlet is disposed below the surface of the water to a second position wherein said exhaust outlet is disposed above the surface of the water.

9. The electrical generator of claim 1 wherein the alternator further comprises a cooling fan connected to the engine crankshaft.

10. The electrical generator of claim 1 further including an inverter electrically connected to at least one AC output receptacle.

11. The electrical generator of claim 10 further comprising at least one DC output receptacle.

12. The electrical generator of claim 1 further comprising feedback control circuitry for controlling engine throttle as a function of electrical load.

13. The electrical generator of claim 1 wherein the engine and alternator are housed within a single enclosure.

14. The electrical generator of claim 13 wherein the enclosure has an appearance similar to an outboard motor housing.

15. The electrical generator of claim 1 wherein the engine is a water cooled engine.

16. The electrical generator of claim 1 further including means for regulating fuel flow to said internal combustion engine in response to electrical demand.

17. The electrical generator of claim 6 wherein said means for regulating fuel flow includes feedback carburetor control for adjusting engine speed in response to electrical load.

18. The electrical generator of claim 7 wherein said feedback carburetor control includes an electric throttle control motor connected to a carburetor and feedback control means for sensing the electrical load placed on the electrical generator, said feedback control means controlling said electric throttle control motor throttle fuel flow.

19. The electrical generator of claim 1 wherein said internal combustion engine further includes means for generating a properly timed electrical pulse electrically connected to a spark plug connected to said internal combustion engine.

20. The electrical generator of claim 19 wherein said means for generating a properly timed electrical pulse comprises an ignition pulse generator.

21. The electrical generator of claim 20 wherein said ignition pulse generator is mounted in close proximity to the periphery of said permanent magnet alternator.

22. The electrical generator of claim 1 wherein said internal combustion engine further includes an ignition pulse generator electrically connected to a spark plug.

* * * * *

UNITED STATES PATENT AND TRADEMARK OFFICE

CERTIFICATE OF CORRECTION

PATENT NO. : 6,579,137 B2
DATED : June 17, 2003
INVENTOR(S) : Alain A. Mabru

It is certified that error appears in the above-identified patent and that said Letters Patent is hereby corrected as shown below:

Title page,
Item [54], delete "MARINE OUTBOARD ELECTRICAL GENERATOR AND ASSEMBLY METHOD" and insert -- MARINE ELECTRICAL GENERATOR --; and Column 8,
Line 13, replace "claim 6" with -- claim 16 --; and
Line 16, replace "claim 7" with -- claim 17 --.

Signed and Sealed this

Thirtieth Day of March, 2004

JON W. DUDAS
*Acting Director of the United States Patent and Trademark Office*